US008429767B2

(12) United States Patent
Frey

(10) Patent No.: US 8,429,767 B2
(45) Date of Patent: Apr. 30, 2013

(54) DISPENSER DEVICE IN PARTICULAR A WC RINSER WITH FIXING MEANS

(75) Inventor: Daniel Frey, Dusseldorf (DE)

(73) Assignee: Henkel AG & CO. KGaA, Duesseldorf (DE)

( * ) Notice: Subject to any disclaimer, the term of this patent is extended or adjusted under 35 U.S.C. 154(b) by 0 days.

(21) Appl. No.: 13/213,212

(22) Filed: Aug. 19, 2011

(65) Prior Publication Data

US 2011/0302704 A1 Dec. 15, 2011

Related U.S. Application Data

(63) Continuation of application No. PCT/EP2010/000558, filed on Jan. 30, 2010.

(30) Foreign Application Priority Data

Feb. 24, 2009 (DE) ..... 10 2009 010 103

(51) Int. Cl.
*E03D 9/02* (2006.01)

(52) U.S. Cl.
USPC ..... 4/231; 4/223

(58) Field of Classification Search ..... 4/222, 223, 4/224, 227.1, 227.6, 227.7, 231, 302
See application file for complete search history.

(56) References Cited

U.S. PATENT DOCUMENTS

| | | | | |
|---|---|---|---|---|
| 4,247,070 | A * | 1/1981 | Dirksing | 4/227.1 |
| 6,694,536 | B1 * | 2/2004 | Haygreen | 4/222 |
| 7,603,726 | B2 * | 10/2009 | Sawalski et al. | 4/223 |
| 2007/0136937 | A1 | 6/2007 | Sawalski et al. | |
| 2007/0204387 | A1 * | 9/2007 | Cornelius et al. | 4/223 |

FOREIGN PATENT DOCUMENTS

| | | | |
|---|---|---|---|
| DE | 10 2006 038 341 | A1 | 2/2008 |
| JP | 2005-344300 | A | 12/2005 |

OTHER PUBLICATIONS

PCT International Search Report (PCT/EP2010/000558) dated Jun. 5, 2010.

* cited by examiner

*Primary Examiner* — Tuan N Nguyen
(74) *Attorney, Agent, or Firm* — Thomas G. Krivulka

(57) ABSTRACT

A release device, such as a toilet freshener that releases at least one preparation into the interior of a toilet bowl, comprises a dispenser, at least one container connected to the dispenser for storing at least one preparation, a release element for releasing preparation, a line connecting the release element and the container in communicating manner, a sensor unit capable of detecting vibrations, and a fastening means for detachably fixing the dispenser to the rim of a toilet bowl. In a preferred embodiment, the fastening means rests at least in part on the toilet bowl and is configured to pick up vibrations, such as structure-borne noise, from the toilet bowl and transmit them to the sensor unit.

11 Claims, 1 Drawing Sheet

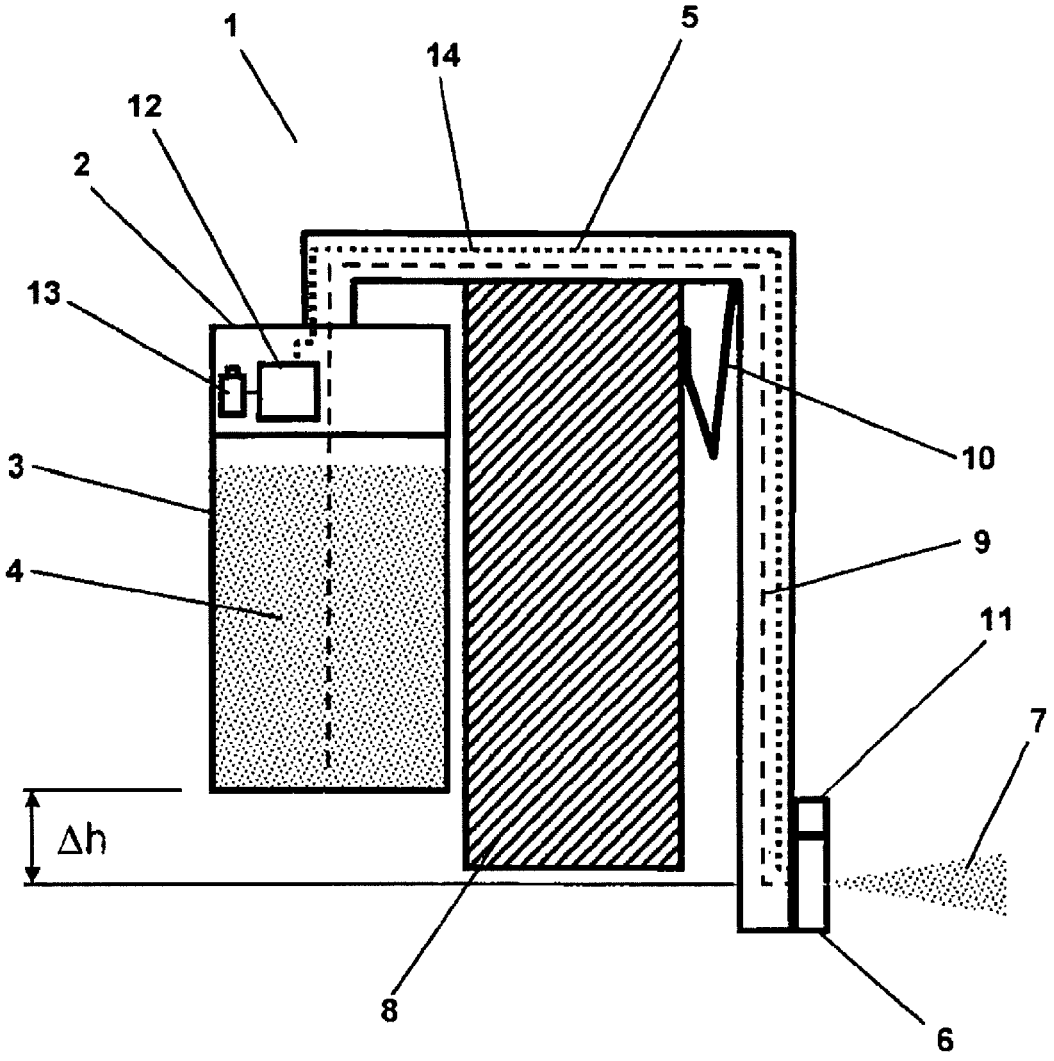
1
14
5
12
2
13
10
3
9
4
11
7
Δh
8
6

DISPENSER DEVICE IN PARTICULAR A WC RINSER WITH FIXING MEANS

CROSS-REFERENCE TO RELATED APPLICATIONS

This application is a continuation of PCT Application Serial No. PCT/EP2010/000558, filed on Jan. 30, 2010, which claims priority under 35 U.S.C. §119 to 10 2009 010 103.9 (DE), filed on Feb. 24, 2009. The disclosures PCT/EP2010/000558 and DE 10 2009 010 103.9 are hereby incorporated by reference in their entirety.

FIELD OF THE INVENTION

The present invention generally relates to a release device and more particularly relates to a toilet freshener that electromechanically releases preparations into the bowl of the toilet upon sensing the flush water.

BACKGROUND OF THE INVENTION

Accurate dispensing of compositions that flow or are otherwise poured is important in many fields of application.

Even in domestic applications, the need to protect the environment and conserve resources has led to increased interest in automatic dispensing of flowable compositions as a way to prevent incorrect or over-dispensing of active substances.

The dispensing of cleaning and scenting compositions in the toilet bowl is presently accomplished by toilet fresheners comprising single or multiple chamber containers that are hung on the rim of the toilet bowl such that active substances are rinsed out from the device with the water during the flushing of the toilet bowl.

Such toilet freshening rim hanging devices are described in WO96/38637 (Mahlhausen, et al.) and DE 101 13 036 B4 (Butter-Jentsch, et al.).

A significant disadvantage of these toilet fresheners is that dispensing substantially depends on the water flow conditions in the toilet bowl during the flushing process. These local flow conditions may differ widely as a function of toilet type and the positioning of the toilet freshener in or on the toilet bowl. For example with certain toilet types, it may happen that no active substance is released from the toilet freshener because no water, or an insufficient amount of water, flows over the toilet freshener during the flushing process. Without a flow of flush water over the toilet freshening device, the dispensing mechanism of the freshener is not initiated.

Furthermore, if flush water does flow as intended over a toilet freshening device, the flush water path intended by the toilet manufacturer is disturbed, whereby the flushing performance of a toilet may be noticeably reduced.

Active substances are usually released from such toilet fresheners by penetration of flush water through openings in the toilet freshener, partial dissolution of active substances, and a discharge of the dissolved materials out from the toilet freshener with the flush water exiting through corresponding outlets in the device. Depending on how the toilet freshener is arranged in the toilet, the strength of water flow through it may vary due to the frequent fluctuations in the flow of flush water through the outlets in the toilet bowl rim, whereby only a minimal release of active substances may be ultimately achieved.

The flush water flow stream is likely affected by the presence of a toilet freshener hanging in or on the rim of the toilet bowl. The changed flow conditions may change the flushing behavior of the toilet markedly. Frequently the flush water stream is adversely affected in such a way that water is splashed upwards out of the toilet bowl, possibly coming into contact with the user of the toilet, creating an unpleasant situation.

Moreover, many toilets are designed with a defined flush water flow path to reduce the quantity of flush water needed for complete flushing. Therefore, any interference with the flush water stream may create an inefficient flushing process that outweighs any benefit in providing freshening actives in the toilet.

There is clearly an unmet need for a toilet freshening device that can dispense active ingredients into the toilet bowl without interfering with the flow of the toilet flush water.

SUMMARY OF THE INVENTION

The present invention is a release device that detects the flush water stream of a toilet without interfering with it. In a preferred embodiment of the present invention, this release device is a toilet refresher. In general, the release device in accordance with the present invention comprises at least one release element, a control unit, a sensor unit, an energy source, a container, a fastening means, and a preparation. The individual components of the release device may be combined into various assemblies.

In an exemplary embodiment of the present invention, a toilet freshener device is provided for releasing at least one preparation into the interior of a toilet bowl. The device preferably comprises a dispenser, at least one container connected with the dispenser for storing at least one preparation, a release element for releasing the preparation such as into the interior of a toilet bowl, a line placing the release element in communication with the container, a sensor unit suitable for detecting vibrations, and a fastening means for detachably fixing the dispenser, e.g. to the rim of a toilet bowl. The fastening means preferably rests at least in part on the toilet bowl, configured such that it picks up vibrations, such as structure-borne noise from the toilet bowl, and transmits them to the sensor unit. In a preferred embodiment of the invention, the components including the release element, control unit, sensor unit and energy source may be combined into a "dispenser" assembly.

BRIEF DESCRIPTION OF THE DRAWING

FIG. 1 illustrates a cross-sectional view of an embodiment of a dispensing device of the present invention configured as a toilet freshener.

DETAILED DESCRIPTION OF THE INVENTION

The following detailed description of the invention is merely exemplary in nature and is not intended to limit the invention or the application and uses of the invention. Furthermore, there is no intention to be bound by any theory presented in the preceding background of the invention or the following detailed description of the invention.

The release device of the present invention comprises at least one release element, a control unit, a sensor unit, an energy source, a container, a fastening means, and a preparation. The individual components of the release device may be combined into various assemblies. The components and assemblies are described in more detail below.

Dispenser

The dispenser comprises the energy source needed for operation of the toilet freshener, a control unit, a sensor unit and at least one release element. The dispenser consists of a housing that prevents the penetration of water splashes from the toilet bowl into the interior of the dispenser.

It is additionally preferable that the dispenser is arranged on the outer rim of the toilet bowl in order to reduce exposure to water splashes and allow for convenient operation of the dispenser. In addition, the dispenser preferably does not physically project into the interior of the toilet. Such an arrangement on the outer rim of the toilet prevents a reduction in the useful cross-sectional area of the toilet bowl.

Depending on the intended purpose, the preparations to be dispensed may have a pH value of between 2 and 12. Therefore all of the components of the toilet freshener that come into contact with such preparations should exhibit the appropriate acid and/or alkali resistance. In addition, proper selection of materials should ensure that these components are as close to chemically inert as possible to such substances as nonionic surfactants, enzymes and/or fragrances.

It is particularly preferred for the electrical components of the toilet freshener, for example the energy source, the control unit, and the sensor unit, to be encapsulated either separately or together in such a way that the dispenser is substantially water-tight and functional even when completely surrounded by liquid. Examples of encapsulating materials which may be used to sheathe these exemplary electrical components include multi-component epoxide and acrylate encapsulation compounds such as methacrylate esters, urethane meth- and cyanoacrylates or two-component materials comprising polyurethanes, silicones, and epoxy resins.

A significant advantage of the present invention is the separation of the toilet freshener into a dispenser and a container couplable with the dispenser, whereby the toilet freshener may be easily adapted for the widest possible range of applications.

In a preferred embodiment of the invention, the number of pins configured on the dispenser corresponds to the number of chambers of the container.

In a further embodiment, a plurality of pins is connected to one line. This means that at least the preparations from two different chambers of the container flow via one line. It is of course possible for all the pins to be connected to a single line.

In order to prevent unwanted mixing of different preparations within a line, it is advantageous for each of the pins to be connected to a separate line, especially when there is a plurality of pins.

In another advantageous embodiment of the invention, each line may be connected to a separate release element. In this manner, each preparation, or mixture of preparations, may be released separately.

Alternatively, a plurality of lines may be connected to one release element, whereby the number of release elements may be reduced.

The release device according to the present invention may be configured as a toilet freshener for releasing at least one preparation into the interior of a toilet bowl. The device may comprise a dispenser, at least one container couplable with the dispenser for storing at least one preparation, and a release element for releasing preparation. The release element may be connected in communication to the container via a line, and the bottom of the container may be arranged vertically above the release orifice of the release element in the direction of gravity such that a difference in level $\Delta h$ is present between the bottom of the container and the release orifice of the release element. When the container and dispenser are coupled, a fluid line extends vertically above the fill level of the preparation, such that, in the flow direction of the preparation through the line, a difference in level $\Delta h$ opposite to the direction of gravity is formed. However, a pin connected to the line on the dispenser interacts with the couplable container in such a manner that, during coupling of the container with the dispenser, it displaces a volume $\Delta v$ of preparation in the container, and subsequently producing a pressure $\Delta p$ in the container that conveys the preparation over the difference in level $\Delta h$ into the line to make dispensation possible.

In this manner, when the dispenser is first coupled with a container, the line is "primed", i.e. filled with preparation, by the coupling process.

It is advantageous for the line to be arranged within a clip that connects the dispenser to the release element, with the clip preferably constructed to be dimensionally stable. This prevents the line being constricted by external mechanical pressures such as the pressing down of the toilet seat, which would reduce or shut off flow of the preparation through the line.

Release Elements

Release elements are any kind of device suitable for releasing an active substance into the surrounding environment of the toilet freshener.

The difference in height $\Delta h$ between the bottom of the container and the release orifice of the release element is between 1 and 30 mm, preferably between 2 and 10 mm, and particularly preferably between 3 and 5 mm.

The release elements may be selected from the group of nozzles, valves, spray heads, droplet dispensers, foam spray heads, piezo elements, porous elements, wick systems, capillary systems, nebulizers, ultrasound nebulizers, ionization nebulizers, and the like.

Electrically controllable nozzles, valves, spray heads, droplet dispensers, foam spray heads, piezo elements, and the like, are particularly suitable for releasing active substances into the toilet or onto the interior surfaces of the toilet bowl.

Electrically controllable nozzles, valves, atomizers, spray heads, piezo elements, sintered plates, porous elements, wick systems, and the like, are particularly suitable for releasing active substance preparation into the air.

The release elements may exhibit identical or different spray patterns when releasing the preparations. For example, it is conceivable for one release element to produce a jet with a somewhat pinpoint target, while another release element produces an extensive application field. It goes without saying that various combinations of the most varied spray pattern shapes are conceivable and within the scope of the present invention.

In particular, the release element may be arranged in a movable manner on the toilet freshener such that the user can orient the spray produced by the release element toward a desired target area. The release element may also comprise means which permit adjustment of the spray cone pattern.

The release element may also provide means for electrostatic charging of active substance droplets, whereby the wetting, adhesion and/or distribution of the active substance on a surface and/or in the air is optimized.

The release elements may be configured such that one or more active substances are released in different directions from one another. TABLE 1 provides some non-exhaustive examples of possible configurations with regard to the direction of release. Any other desired combinations of the configurations shown in TABLE 1 are within the scope of the present invention.

TABLE 1

| Examples of Release Directions | |
|---|---|
| Direction of release A | Direction of release B |
| Release of scent into toilet bowl | Release of scent into surrounding environment |
| Release of cleaning agent into toilet bowl | Release of cleaning agent under the toilet rim; during flushing or outside the flushing process |
| Release of cleaning agent into toilet bowl | Release of scent into surrounding environment |

It is advantageous to arrange the release element in a movable manner on the clip of the toilet freshener. In this way, the user may purposefully orient the release element and the spray pattern of the preparation in order to wet a defined target zone in or on the toilet with preparation.

The release element(s) is/are advantageously configured such that, irrespective of the positioning of the toilet freshener on the toilet bowl, a defined amount of at least one active substance preparation is released in a directed and defined manner into the interior of a toilet bowl. The advantages of such a configuration are inter alia the more specific exposure of surfaces of the toilet bowl to one or more active substances, wherein different surfaces may be treated with active substances that differ from one another. For example, in the case of a German style flat-pan toilet, the pan may be wetted with an active substance for reducing adhesions, while an active substance for reducing lime deposits is applied onto the funnel-shaped walls extending from the pan to the rim of the toilet.

The control unit may in particular comprise a programmable microprocessor. In one particularly preferred embodiment of the invention, a plurality of dispensing programs is stored in the microprocessor.

In particular, the dispensing programs may be automatically selected and executed depending on the container coupled to the toilet freshener. It is, of course, likewise conceivable for the dispensing programs to be manually selected by the user.

The control unit is preferably arranged on the outwardly directed side of the toilet bowl, from where it may be straightforwardly operated by the user, in particular when the user is sitting on the toilet.

In a preferred embodiment, the control unit may comprise a dispensing program that releases preparation into the toilet bowl during the second half, and most preferably during the final third, of the flushing process.

In a particularly preferred embodiment, the control unit may comprise a dispensing program that directs introduction of at least two different active substance preparations into a toilet bowl or into the surrounding environment of the toilet bowl, at least at two successive points in time ($t_1$ and $t_2$), whereby at least one active substance preparation is introduced into the interior of a toilet bowl.

A substantial advantage of such a dispensing program is inter alia optimized cleaning performance due to a precise control of possible chemical reactions using appropriately time-offset release of the corresponding preparation or preparations, some examples of which are listed, but not exhaustively, in TABLE 2 below.

TABLE 2

| Timed Dispensing of Preparations and Associated Advantages | | |
|---|---|---|
| $t_1$ | $t_2$ | Advantage |
| Cleaning product released in the toilet bowl during flushing process | Scent released in the toilet bowl after flushing | Optimized scent development, since scent is released into the toilet bowl after flushing and not flushed away with the flush water. Scent is not "decomposed" by cleaning preparation. |
| Scent released in the toilet bowl immediately before use | Cleaning product released in the toilet bowl during flushing process | Optimized scent development, since scent is released into the toilet bowl before flushing and is consequently not flushed away with the flush water. Scent is not "decomposed" by cleaning preparation. |
| Cleaning product A released in toilet bowl immediately before use | Cleaning product B released in toilet bowl during flushing process | Cleaning product A may prevent adhesions in the toilet bowl by a protective film of cleaning product A applied in the toilet bowl immediately before the toilet is used. That protective film is then flushed back off the toilet surface by cleaning product B during the flushing process. |

In an additional preferred embodiment of the invention, the control unit generates a control signal for releasing active substance preparation when flushing is initiated and a control signal for terminating active substance release once flush water has stopped flowing through the toilet bowl.

In an advantageous configuration of the toilet freshener in accordance with the present invention, the first amount released and at least the second amount released originate from identical or different active substance preparations.

In accordance with a preferred embodiment, the first amount released and at least the second amount released are released at different points in time.

Control Unit

A control unit for the purposes of the present application is a device suitable for influencing the transport of material, energy and/or information.

A further advantage is that it is possible to achieve controlled release of one or more different scents as a method to reduce olfactory habituation. A procedure of cyclic and pulsed release of scent, as is known from the prior art, may be used for this purpose. Habituation may also be reduced by releasing different scents in succession.

It is also conceivable for the toilet freshener to dispense a defoamer into the toilet bowl before or during the flushing process. Excessive foaming before or during the flushing process frequently causes toilet paper to float on the foam such that the toilet paper is not properly flushed away with the flush water to be found still floating in the toilet bowl after toilet flushing. Consumers often consider this unappealing. By apportioning the defoamer before or during the flushing process, excessive foaming can be prevented, ensuring that the toilet paper is reliably flushed away. In addition to, or as an alternative to the defoamer, cellulose-dissolving substances may also be apportioned.

In an additional advantageous embodiment of the invention, the release element and at least the first preparation are configured such that foam is formed on release of the preparation into the surrounding environment.

Foaming exhibits a plurality of possible advantages. On the one hand, a foam is capable of effectively trapping and minimizing malodors due to its pore and cell structure. On the other hand, the foam may also be applied onto the surface of the toilet bowl as an "anti-caking" coating in order to reduce adhesions of excreted metabolites on these surfaces.

For this purpose, it is advantageous that the release element be configured as a foam spray head and for the preparation to have a viscosity of less than 3000 mPa·s, such that a maximally stable, effectively adhering and fine-pored foam can be formed.

In a particularly advantageous embodiment of the invention, at least one method for operating a toilet freshener is stored in the control unit, the toilet freshener comprising a sensor unit, a control unit, a release element and at least one container for storing at least one preparation, the release element and the container being connected to one another in communicating manner and flush water flow through the toilet bowl taking place within a flushing water period $[t_1\text{-}t_2]$, in which $t_1$ represents the start of flush water flow and $t_2$ the end of flush water flow, and the sensor unit detecting triggering of a flush water stream through the toilet bowl within the flushing water period $[t_1\text{-}t_2]$ at a time $t_s$, the sensor signal, which represents triggering of the flush water stream, being passed to the control unit, the control unit converting the sensor signal into a control signal for the release element, such that preparation is released from the container by the release element into the interior of the toilet bowl, release of the preparation from the container by the release element taking place with a time delay $\Delta t$ after detection of the flush stream by the sensor unit at time $t_s$.

In particular, the time delay $\Delta t$ is between 1 and 10 s, preferably between 1 and 5 s, and particularly preferably between 1 and 3 s.

It is furthermore preferred that the release period $\Delta t_1$ for the preparation to be between 0.25 and 2 s, preferably between 0.5 and 1.5 s, and particularly preferably between 0.75 and 1.25 s. The quantity of preparation released during the release period $\Delta t_1$ is preferably between 0.05 and 0.5 ml, preferably 0.075 and 0.3 ml, and particularly preferably 0.1 and 0.2 ml.

The preparation is preferably released at intervals of $\Delta t_p$, meaning that after a first release of preparation at least one further release takes place. It is preferred for the intervals $\Delta t_p$ to be periodic. It is very particularly preferred for the periodic intervals $\Delta t_p$ to amount to between 0.5 and 10 s, preferably between 1 and 7 s, and in particular between 1 and 5 s.

The method for operating a toilet freshener is advantageously designed such that preparation is not released if the sensor unit has detected end of flush water flow $t_2$.

It is furthermore advantageous for the duration of a measured flushing water period $[t_1\text{-}t_2]$ to be stored in the control unit. In this manner, it is possible to determine the characteristic flushing periods of a toilet in the control unit and, on this basis, to release preparation in a manner adapted and optimized to the characteristic flushing periods. It is therefore particularly advantageous to store a plurality of measured flushing water periods $[t_1\text{-}t_2]$ in the control unit.

Since a toilet often has mutually differing flushing periods, for example a "normal" flushing period and a water-saving flushing period, it is preferred for the measured flushing water periods $[t_1\text{-}t_2]$ to be classified with regard to their frequency distribution. It is here in particular advantageous to detect at least one first class of flushing water periods of between 4 and 8 s and at least one second class of flushing water periods of between 2 and 4 s.

In order to achieve good foam formation at the end of the flushing process, it is very particularly preferred for the preparation to be released from the container by the release element with a time delay $\Delta t$ after detection of the flush stream by the sensor unit at time $t_s$, $\Delta t$ being selected such that release takes place in the final third of a flushing water period $[t_1\text{-}t_2]$.

The time delay $\Delta t$ with which the preparation is released after detection of the flush stream $t_s$ may in particular be stored in the control unit. The method may however also be designed such that the time delay $\Delta t$ with which the preparation is released after detection of the flush stream $t_s$ is determined by the control unit.

Sensor Unit

The sensor unit may comprise one or more active and/or passive sensors for the qualitative and/or quantitative detection of mechanical, electrical, physical and/or chemical variables which are passed to the control unit as control signals.

A sensor unit preferably detects triggering of the flush water stream substantially without intervening in the flush water flow and generates a sensor signal, which is passed to the control unit, which converts the sensor signal into a control signal for releasing at least one preparation.

Substantially without intervening means that the flush water stream is not influenced, i.e. the stream does not undergo any significant deviation. It is therefore particularly preferred for the sensor unit to operate without contact with the flush water stream. However, it is also feasible for the sensor unit to be brought into contact with the flush water stream, whereby the flush water stream is not influenced. In the sensor unit this may be brought about for example by a thin rod or wire, which is introduced into the flush water stream perpendicularly to the flush water flow direction.

In particular, the sensors of the sensor unit may be selected from the group of timers, infrared sensors, brightness sensors, temperature sensors, motion sensors, strain sensors, rotational speed sensors, proximity sensors, flow sensors, color sensors, gas sensors, vibration sensors, pressure sensors, conductivity sensors, turbidity sensors, instantaneous acoustic pressure sensors, "lab-on-a-chip" sensors, force sensors, acceleration sensors, inclination sensors, pH sensors, moisture sensors, magnetic field sensors, RFID sensors, magnetic field sensors, Hall sensors, biochips, odor sensors, ultrasound sensors, acoustic sensors, hydrogen sulfide sensors and/or MEMS sensors.

In particular, a vibration sensor may be configured to pick up structure-borne noise on a toilet bowl.

In its simplest conceivable embodiment, the sensor unit may also be embodied as a toggle, pressure or momentary-contact switch.

It is additionally advantageous for a dispensing process in which a defined amount of a preparation is released to last less than 20 seconds, preferably less than 10 seconds, particularly preferably less than 5 seconds. By providing the shortest possible dispensing period in which a preparation is released into the surrounding environment, the dispenser may rapidly be available for the next dispensing period and so ensure effective release of preparation even if a toilet is in continual use.

Energy Source

For the purposes of the present application, an energy source is taken to mean a component of the dispenser which is capable of providing energy that is suitable for autonomous operation of the dispenser.

The energy source preferably provides electrical energy. The energy source may for example comprise a battery, a mains power supply, solar cells or the like.

It is also conceivable to transmit the electrical power necessary for operating the dispenser wirelessly by means of radio waves from an appropriate transmitter to a corresponding receiver in the dispenser.

It is particularly advantageous to make the energy source interchangeable, for example in the form of a replaceable battery.

Container

For the purposes of the present application, a container is taken to mean a packaging means suitable for enclosing or holding preparations, which is couplable to the dispenser for releasing the preparation.

The container is preferably detachably connected to the dispenser.

A particularly preferred arrangement comprises two containers separate from one another, wherein each contains an active substance fluid. However, there may be a plurality of storage containers for a plurality of active substance fluids. The storage containers are separate from one another in order to prevent premature mixing of the active substance fluids. They may be physically separate or take the form of separate compartments in a single body.

The volume ratio of the structural volume of the dispenser and the capacity of the container preferably amounts to <1, particularly preferably <0.1, particularly preferably <0.05. In this way it is ensured that, in the case of a predetermined overall structural volume of dispenser and container, the predominant proportion of the structural volume is occupied by the container and the preparation contained therein.

The container conventionally has a capacity of <5000 ml, in particular <1000 ml, preferably <500 ml, particularly preferably <250 ml, very particularly preferably <50 ml.

The invention is particularly suited for dimensionally stable containers such as pots, tins, capsules, cartridges, bottles, canisters, cans, cartons, drums or tubes, but may also be configured for flexible containers such as pouches or bags, in particular if they are used in accordance with the bag-in-bottle principle.

In particular, a container may also comprise a plurality of chambers filled with different compositions. It is also conceivable for a plurality of containers to be combined into a unit, for example a cartridge.

TABLE 3 shows examples of possible combinations of containers or chambers with the corresponding preparations for some applications.

TABLE 3

| Combinations of Containers or Chambers | | |
|---|---|---|
| Container A | Container B | Container C |
| Cleaning agent | | |
| Cleaning agent | Scent | |
| Cleaning agent A | Cleaning agent B | |
| Cleaning agent A | Cleaning agent B | Scent |

In a particularly preferred embodiment of the present invention, the outlet orifice of the container is provided at the top of the container contrary to the direction of gravity, such that no outflow from the outlet orifice can take place under the action of gravity when the container is in the service and coupled position. Arranging the outlet orifice on the top also has the advantage that, in the service position, a fluid column does not reach above the orifice, whereby the outlet orifice may more simply and reliably be sealed relative to the dispenser.

The container couplable with the toilet freshener is advantageously closed with a closing means.

In particular, the closing means interacts with the pin of the dispenser in such a manner that a seal is formed between the pin and closing means during coupling of the dispenser and container.

For the purposes of the present application, a seal comprises elements that have the function of preventing or limiting unwanted mass transfer, including pressure equalization, from one chamber to another.

The seal may in particular be a rotational and/or translational seal.

The seal may in particular be selected from the group of radial shaft sealing rings, labyrinth seals, floating ring seals, packing glands, piston rings, bellows, brush seals, axial shaft sealing rings and/or rotary transmission leadthroughs.

It is also preferred for the seal between pin and closing means to be configured during coupling of dispenser and container in such a manner that the overpressure $\Delta p$ arising during coupling does not escape from the container via the seal.

In accordance with a further preferred embodiment of the invention, the line opens into the container, it being particularly preferred for the line to open more or less at the bottom of the container.

The line and the preparation may advantageously be configured such that preparation is drawn into the line by capillary action. For example, the line may take the form of a wick, at least in places.

In a preferred embodiment of the invention, the container comprises an RFID label which at least contains information about the contents of the container and which is readable by the sensor unit.

This information may be used in order to select a dispensing program stored in the control unit. In this way it may be ensured that the ideal dispensing program is always used for a specific preparation. It may also be provided that, in the absence of an RFID label or in the case of an RFID label with an incorrect or defective ID, the dispenser does not dispense but instead an optical or acoustic signal is produced that notifies the user of the error.

In order to prevent misuse of the containers, the containers may also comprise structural elements which interact with corresponding elements of the dispenser like a key in a lock, such that for example only containers of a particular type are couplable to the dispenser. This development furthermore makes it possible for information about the container coupled to the dispenser to be transmitted to the control unit, whereby the dispenser may be controlled in a manner adapted to the contents of the corresponding container.

In a further development of the invention, the container may be under pressure. This is in particular advantageous if the preparation is to be sprayed or released. This embodiment has the further advantage that no energy need be provided by the energy source for transporting the preparation, meaning that the energy source may either be made smaller or will have a longer anticipated life.

Fastening Means

The toilet freshener of the present invention also comprises fastening means in order to fix the toilet freshener to the toilet bowl. The fastening means may for example take the form of a suction cup, adhesive tape, a clip or the like.

The toilet freshener may alternatively be fastened to the toilet cistern, the toilet seat, or to the toilet lid. Fastening means sufficiently well known from the prior art may be used for this purpose.

In particular, the fastening means may be constructed for detachable fixing of the dispenser to the rim of a toilet bowl in such a manner that the fastening means rests at least at least in part on the toilet bowl and is configured to pick up vibrations, in particular structure-borne noise, from the toilet bowl and transmit them to the sensor unit.

It is preferable to configure the fastening means as a spring, and for the spring to substantially comprise a V-, U-, N-, M-, or W-shape.

In order to ensure adequate transmission of vibrations and/or structure-borne noise from the toilet to the fastening means, it is advantageous for the spring to press with a spring force of at least 0.5 N against a surface of the toilet bowl.

It is particularly advantageous for the spring to be arranged on a leg of the U-shaped clip which is vertical in the service position of the release device, it being particularly preferred for the spring to be arranged on the leg of the U-shaped clip directed towards the interior of the toilet bowl.

Preparations

Preparations for the purpose of these applications are compositions which contain at least one substance from the group of cleaning agents and/or scents.

In accordance with an additional preferred embodiment of the invention, the preparations comprise substances for surface modification, where the surfaces are in particular ceramic surfaces.

Suitable preparations according to the invention are for example scent phases, and in particular perfumed scent phases. Such scent phases conventionally contain at least one scent, preferably perfume oil, at least one surfactant or an emulsifier, and water, along with optional ingredients such as preservatives, thickeners, complexing agents, dyes, further surfactants, or emulsifiers, stabilizers, limescale removers, and the like.

Preparations which are likewise suitable according to the invention are bleach phases, in particular chlorine-containing bleach phases, preferably bleach phases based on hypochlorite, wherein, in addition to the actual bleaching agent and water, the bleach phases may optionally contain additional ingredients such as thickeners, surfactants or emulsifiers, neutralizing agents, dyes, scents, and the like.

Additional preparations that are suitable according to the invention are limescale removing active substance phases, preferably acidic limescale removing active substance phases. In addition to the actual limescale remover (which preferably comprises an organic or inorganic acid) and water, such limescale removing active substance phases may optionally contain ingredients such as surfactants or emulsifiers, thickeners, scents, preservatives, and the like.

It is likewise possible to use highly concentrated surfactant phases, or "foam boosters" as they are known, as preparations. In addition to the surfactants, such highly concentrated surfactant phases may also contain still further, conventional ingredients. Such foam boosters are in particular advantageous for pretreating the toilet bowl with a carpet of foam, in order to prevent or reduce adhesion of excreted metabolites on the surface of the toilet and/or to trap malodors.

Preparations with an antibacterial and/or fungicidal and/or antiviral active substance phase are likewise suitable according to the invention, wherein in addition to the antibacterial and/or fungicidal and/or antiviral active substance and water, the active substance phase may optionally contain further ingredients, such as for example surfactants or emulsifiers, thickeners, scents, preservatives, etc.

It is furthermore possible for the preparations to be enzyme-containing active substance phases. In addition to enzyme(s) and water, such enzyme-containing active substance phases may optionally contain further ingredients such as surfactants or emulsifiers, thickeners, scents, preservatives, etc.

It is likewise possible for the preparations used according to the invention to be absorbent, in particular odor-absorbing active substance phases. In addition to the absorbent, in particular odor absorbent, and water, said phases may optionally contain further ingredients such as surfactants or emulsifiers, thickeners, scents, preservatives, etc.

According to one particular embodiment, the toilet freshener according to the invention provides the possibility of using combinations of different preparations in the storage containers, wherein according to a preferred embodiment, one of the storage containers contains a scent phase, in particular as defined above.

Examples of preparation combinations to be used are a perfumed scent phase combined with chlorine bleach (not stable when stored together), perfumed scent phase with highly concentrated surfactant phase (foam boosters), scent phase with limescale removing, acidic active substance phase, scent phase with antibacterial active substance phase, various acid systems, scent phase combined with enzyme-containing active substance phase, perfumed acid phase combined with water-coloring phase, scent phase with odor-absorbing phase, perfumed acid phase with active oxygen, perfumed acid phase with active substance phase, polyacrylate-thickened etc.

High-viscosity to gel-like active substance fluids having viscosities in the order of a few thousand mPa·s, in particular from 200 to 5000 mPa·s, and preferably 500 to 3500 mPa·s (measured with RotoVisko LVTV II, spindle 31, 5 rpm, 20° C.) are of particular interest here.

In a further, preferred development of the invention, the preparations have a viscosity of less than 2000 mPa·s, and in particular of less than 1000 mPa·s (measured with RotoVisko LVTV II, spindle 31, 5 rpm, 20° C.). Such low-viscosity or water-thin preparations are particularly suitable for spraying into or onto the toilet bowl.

Using low-viscosity active substance preparations in conjunction with the present toilet freshener makes it possible to achieve substantially faster and more accurate dispensing and to dispense with the use of thickening systems. Active substance systems may also be used that can only be prepared in low viscosities, for example based on chlorine, HCl, etc.

When using a preparation with a release element taking the form of a piezo oscillator, it is advantageous that the preparation not contain any solids. It is also preferable for the preparation not to be an emulsion.

Examples of Application

In addition to use as a toilet freshener for releasing at least one preparation into the interior of a toilet bowl, it is also conceivable to use the present device for releasing preparations into a water-conveying domestic appliance such as a washing machine, dishwashing machine or washer/dryer. The application is therefore not restricted to use as a toilet freshener for a toilet, which has herein been described only by way of an example to clarify the invention.

The invention is illustrated in greater detail below with reference to the single drawing figure. The drawing figure only represents exemplary embodiments and does not limit the scope of the invention in any way. Particularly preferred embodiments and combinations of features are also described in detail with reference to the drawing figure.

FIG. 1 depicts an embodiment of the release device of the present invention configured as a toilet freshener 1. The toilet freshener 1 consists of the dispenser 2 and a container 3 couplable with the dispenser 2. The container 3 stores a preparation 4. FIG. 1 shows the dispenser 2 and the container 3 in their coupled configuration.

A clip 5 configured in a U-shape extends from the top of the dispenser 2 with the dispenser 2 arranged on the vertical leg of the U-shaped clip 5 extending on the outside of the toilet. A release element 6 and a sensor unit 11 are positioned at the distal end of the other vertical leg of the U-shaped clip 5 that extends inside the toilet. Lastly, the horizontal leg of the U-shaped clip 5 rests on the toilet bowl 8.

The bottom of the container 3 and the release orifice of the release element 6 are spaced apart from one another in the direction of gravity by a difference in height Δh. The release element 6 and the container 3 are connected to one another in communicating manner via the line 9, with line 9 reaching down to the bottom of the container 3. Due to the difference in level Δh, preparation 4 is conveyed out of the container 3 through the line 9 to the release element 6.

The release element 6 in this exemplary embodiment comprises a piezo oscillator. The sensor unit 11 comprises a vibration sensor, and in particular a structure-borne noise sensor. As seen from FIG. 1, the vibration sensor 11 may be arranged on the freely mobile and distal end of the other vertical leg of the clip 5 that extends on the inside of the toilet. As a consequence, the vibration sensor 11 undergoes the greatest possible amplitude of oscillation, so improving the sensitivity of the sensor 11.

The release element 6 and the sensor unit 11 are connected to one another through the control unit 12 via a signal/power line 14, such that control signals are transmitted to the release element 6 and from the sensor unit 11. The electrical energy required for this purpose is supplied by a battery 13 or a storage battery arranged in the dispenser.

The clip 5 is preferably dimensionally stable in construction such that the line 9 and/or the signal/power line 14, which preferably extend inside the clip 5, are protected from mechanical influences. However, it is also possible to arrange the line 9 and/or the signal/power line 14 outside clip 5.

In the illustrated embodiment, a fastening means 10 is configured in the form of a spring arranged on the vertical leg of the clip 5 that extends vertically on the inward facing side of the toilet bowl. The spring 10 may have a substantially V-shaped construction as shown in the example, wherein one leg of the V-shaped spring 10 is firmly arranged on the clip 5 while the free leg of the V-shaped spring 10 presses against the inner surface of the toilet bowl 8. On the one hand this configuration results in a detachable fixing of the toilet freshener 1 to the toilet bowl 8. On the other hand, vibrations and/or structure-borne noise are transmitted from the toilet bowl 8 to the toilet freshener 1 and in particular to the sensor unit 11 of the freshener 1.

While at least one exemplary embodiment has been presented in the foregoing detailed description of the invention, it should be appreciated that a vast number of variations exist. It should also be appreciated that the exemplary embodiment or exemplary embodiments are only examples, and are not intended to limit the scope, applicability, or configuration of the invention in any way. Rather, the foregoing detailed description will provide those skilled in the art with a convenient roadmap for implementing an exemplary embodiment of the invention, it being understood that various changes may be made in the function and arrangement of elements described in an exemplary embodiment without departing from the scope of the invention as set forth in the appended claims and their legal equivalents.

I claim:

1. A toilet freshener for releasing at least one preparation into the interior of a toilet bowl having an interior, a rim and a outwardly directed side, said toilet freshener comprising:

a) a dispenser arranged on the outwardly directed side of the toilet bowl;

b) at least one container connected to said dispenser;

c) a preparation stored in each of said at least one container;

d) a release element configured for releasing said preparation;

e) a line connecting said release element and said container in a communicating manner;

f) a sensor unit capable of detecting vibrations; and g) a fastening means for detachably fixing said dispenser to the rim of a toilet bowl, said fastening means resting at least in part on the toilet bowl and configured to pick up vibrations from the toilet bowl and transmit the vibrations to said sensor unit.

2. The toilet freshener of claim 1 further including a control unit, said control unit comprising a programmable microprocessor.

3. The toilet freshener of claim 2 further including a signal/power line connecting said control unit to both said release element and said sensor unit such that control signals are transmitted from said control unit to said release element and from said sensor unit to said control unit.

4. The toilet freshener of claim 1 further including a clip connecting said dispenser to said release element, wherein said release element is arranged on said clip on the inwardly directed side of the toilet bowl.

5. The toilet freshener of claim 4, wherein said clip is substantially in a U-shape.

6. The toilet freshener of claim 5, wherein said fastening means comprises a spring, said spring arranged on a vertical leg of said U-shaped clip when said toilet freshener is in the service position on the toilet bowl.

7. The toilet freshener of claim 1, wherein said fastening means comprises a spring.

8. The toilet freshener of claim 7, wherein said spring presses against a surface of the toilet bowl with a spring force of at least 0.5 N.

9. The toilet freshener of claim 1, wherein said sensor unit is a structure-borne noise sensor.

10. The toilet freshener of claim 1, wherein said release element comprises a piezo oscillator.

11. The toilet freshener of claim 1, wherein said sensor unit is incorporated in said release element.

* * * * *